US005996236A

United States Patent [19]

Branting

[11] Patent Number: 5,996,236

[45] Date of Patent: Dec. 7, 1999

[54] SELF CENTERING PUNCH

[76] Inventor: Randall L. Branting, 6028 Stoneridge Road, Duncan, Canada, V9L 5J6

[21] Appl. No.: 09/010,750

[22] Filed: Jan. 22, 1998

[51] Int. Cl.[6] ..... B26F 1/00

[52] U.S. Cl. ..... 30/366; 30/368

[58] Field of Search ..... 30/366–368; 33/520, 33/644

[56] References Cited

U.S. PATENT DOCUMENTS 2,748,492 6/1956 Lockhart ..... 30/367 X

*Primary Examiner*—Douglas D. Watts

[57] ABSTRACT

A hole puncher is provided including a central sleeve. At least three legs are pivotally coupled to the central sleeve and adapted to extend radially therefrom. Finally, a punch is situated within the central sleeve for punching a hole in a center of a circle.

10 Claims, 2 Drawing Sheets

SELF CENTERING PUNCH

BACKGROUND OF THE INVENTION

1. Field of the Invention

The present invention relates to hole punchers and more particularly pertains to a new self centering punch for punching a hole in a center of a circle inscribed on a recipient surface.

2. Description of the Prior Art

The use of hole punchers is known in the prior art. More specifically, hole punchers heretofore devised and utilized are known to consist basically of familiar, expected and obvious structural configurations, notwithstanding the myriad of designs encompassed by the crowded prior art which have been developed for the fulfillment of countless objectives and requirements.

Known prior art hole punchers include U.S. Pat. No. 4,370,907; U.S. Pat. No. 4,138,824; U.S. Pat. No. 4,991,306; U.S. Pat. No. 4,823,468; U.S. Pat. No. 5,437,105; and U.S. Patent Des. 274,414.

In these respects, the self centering punch according to the present invention substantially departs from the conventional concepts and designs of the prior art, and in so doing provides an apparatus primarily developed for the purpose of punching a hole in a center of a circle inscribed on a recipient surface.

SUMMARY OF THE INVENTION

In view of the foregoing disadvantages inherent in the known types of hole punchers now present in the prior art, the present invention provides a new self centering punch construction wherein the same can be utilized for punching a hole in a center of a circle inscribed on a recipient surface.

The general purpose of the present invention, which will be described subsequently in greater detail, is to provide a new self centering punch apparatus and method which has many of the advantages of the hole punchers mentioned heretofore and many novel features that result in a new self centering punch which is not anticipated, rendered obvious, suggested, or even implied by any of the prior art hole punchers, either alone or in any combination thereof.

To attain this, the present invention generally comprises a central sleeve having a rigid cylindrical configuration with an open top end, an open bottom end and a periphery formed therebetween. An outer surface of an upper extent of the periphery has a plurality of threaded grooves formed therein. Note FIG. 1. Three spaced posts are coupled to the sleeve just below the threaded grooves and extend radially therefrom. Each post has an outboard end with a horizontally oriented aperture and a vertically oriented slot. Further provided is three legs each constructed from an elongated planar plate. Each plate has an elongated lower extent with an arcuate inboard edge and an arcuate outboard edge. The plates further have an angled short upper extent forming an obtuse angle with the lower extent. As shown in FIG. 1, each leg is pivotally coupled at a point just below an intersection of the upper and lower extent. Such coupling preferably afforded within the slot of a corresponding one of the posts of the sleeve. Also included is a leg adjustment assembly having a stopper with a cylindrical upper extent and a lower extent having an inverted frusto-conical configuration. The stopper has a threaded bore formed therein for screwably coupling with the grooves of the sleeve. The stopper serves for biasing the lower extent of each leg inwardly. The leg adjustment assembly further includes an elastic band. The band is situated about the legs at the intersections thereof for urging the upper extents of the legs in constant abutment with the stopper. Finally, a punch is provided having a cylindrical configuration with a conical lower end with a retaining ring mounted thereabove. An upper end of the punch is equipped with another retaining ring mounted thereon. The punch is slidably situated within the sleeve and adapted to be moved between the retaining rings.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new self centering punch apparatus and method which has many of the advantages of the hole punchers mentioned heretofore and many novel features that result in a new self centering punch which is not anticipated, rendered obvious, suggested, or even implied by any of the prior art hole punchers, either alone or in any combination thereof.

It is another object of the present invention to provide a new self centering punch which may be easily and efficiently manufactured and marketed.

It is a further object of the present invention to provide a new self centering punch which is of a durable and reliable construction.

An even further object of the present invention is to provide a new self centering punch which is susceptible of a low cost of manufacture with regard to both materials and labor, and which accordingly is then susceptible of low prices of sale to the consuming public, thereby making such self centering punch economically available to the buying public.

Still yet another object of the present invention is to provide a new self centering punch which provides in the apparatuses and methods of the prior art some of the advantages thereof, while simultaneously overcoming some of the disadvantages normally associated therewith.

Still another object of the present invention is to provide a new self centering punch for punching a hole in a center of a circle inscribed on a recipient surface.

Even still another object of the present invention is to provide a new self centering punch that includes a central sleeve. At least three legs are pivotally coupled to the central sleeve and adapted to extend radially therefrom. Finally, a punch is situated within the central sleeve for punching a hole in a center of a circle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
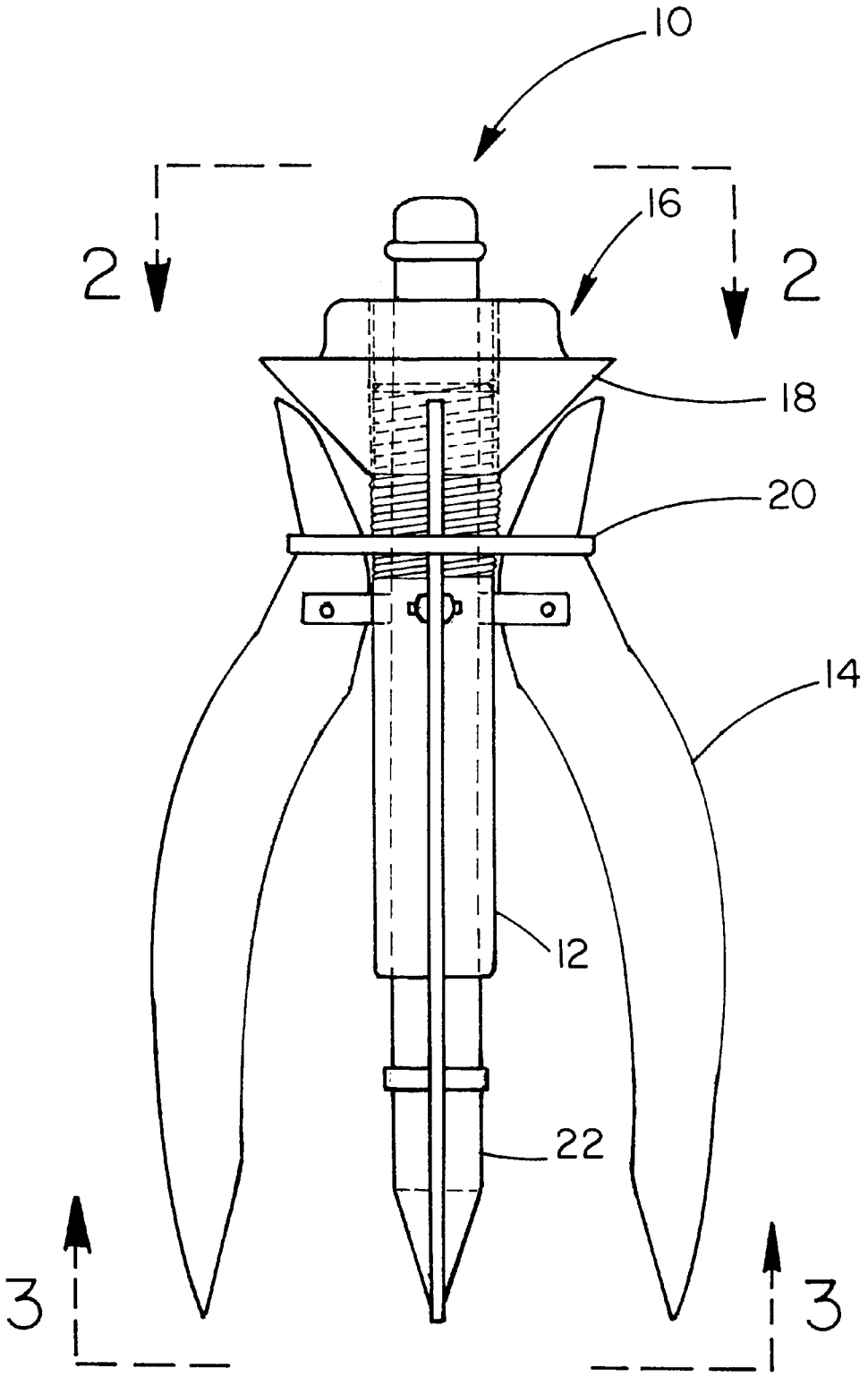
FIG. 1 is a side view of a new self centering punch according to the present invention.
Figure 2:
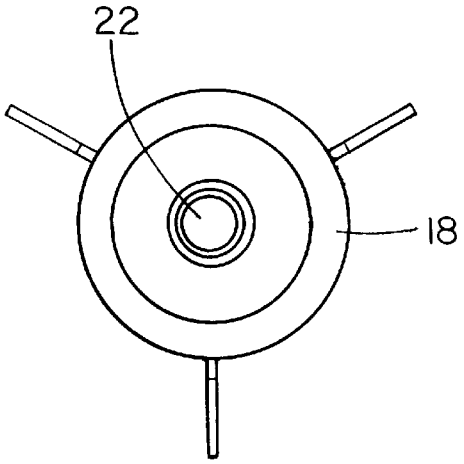
FIG. 2 is a bottom view of the present invention.
Figure 3:
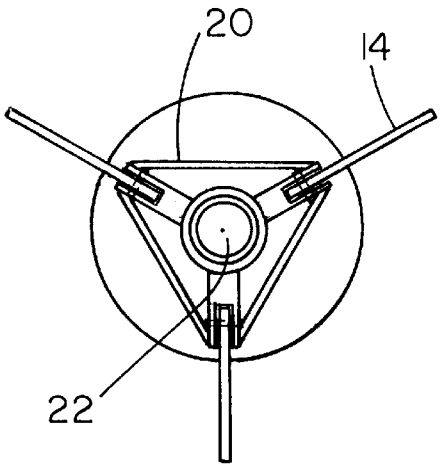
FIG. 3 is a top view of the present invention.
Figure 4:
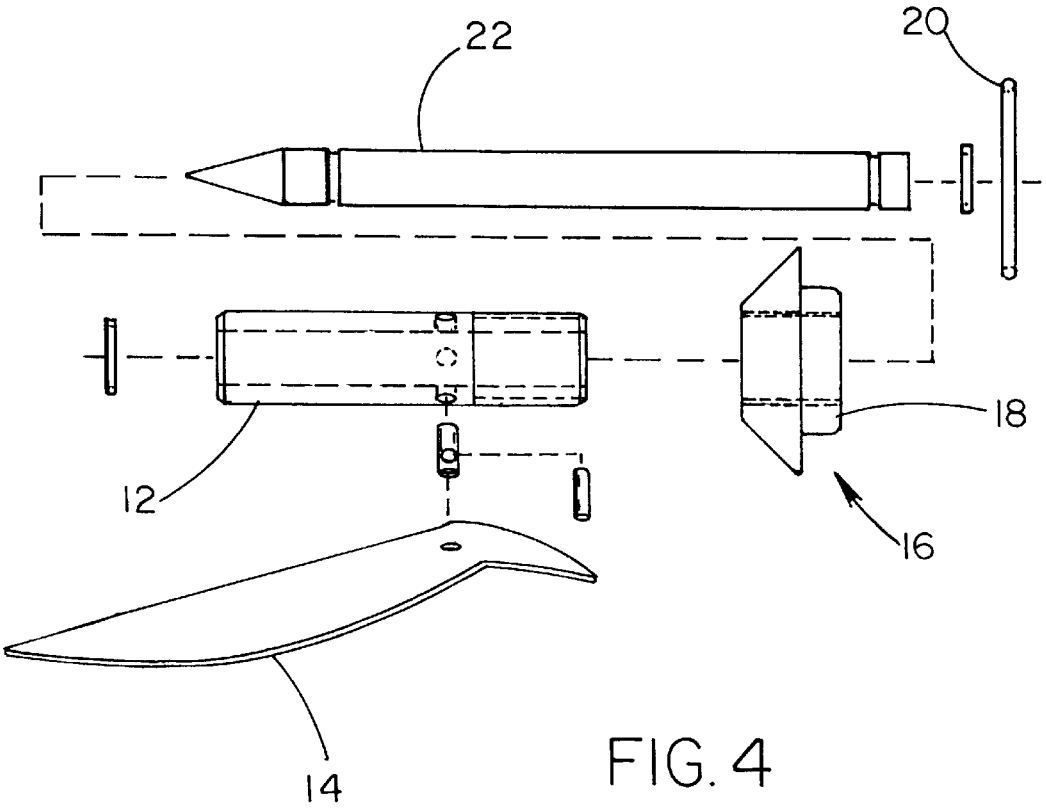
FIG. 4 is an exploded view of the present invention.

With reference now to the drawings, and in particular to FIGS. 1 through 4 thereof, a new self centering punch embodying the principles and concepts of the present invention and generally designated by the reference numeral 10 will be described.

The present invention, designated as numeral 10, includes a central sleeve 12 having a rigid cylindrical configuration with an open top end, an open bottom end and a periphery formed therebetween. An outer surface of an upper extent of the periphery has a plurality of threaded grooves formed therein. Note FIG. 1. Three spaced posts are coupled to the sleeve just below the threaded grooves and extend radially therefrom. Each post has an outboard end with a horizontally oriented aperture and a vertically oriented slot.

Further provided is three legs 14 each constructed from an elongated planar plate. Each plate has an elongated lower extent with an arcuate inboard edge and an arcuate outboard edge. The plates each further has an angled short upper extent forming an obtuse angle with the lower extent. It is apparent from the Figures that the upper extent is preferably less than ¼ the length of the entire leg. As shown in FIG. 1, each leg is pivotally coupled at a point just below an intersection of the upper and lower extent. Such coupling is preferably afforded within the slot of a corresponding one of the posts of the sleeve via a pin. See FIG. 4.

Also included is a leg adjustment assembly 16 having a stopper 18 with a cylindrical upper extent and a lower extent having an inverted frusto-conical configuration. The stopper has a threaded bore formed in concentric relationship therewith for screwably coupling with the grooves of the sleeve. The stopper serves for biasing the lower extent of each leg inwardly. The leg adjustment assembly further includes an elastic band 20. The band is situated about the legs at the intersections thereof for urging the upper extents of the legs in constant abutment with the stopper.

Finally, a punch 22 is provided having a cylindrical configuration with a conical lower end with a retaining ring mounted thereabove. An upper end of the punch is equipped with another retaining ring. The retaining rings are each ideally mounted within annular grooves formed in the punch. During use, the punch is slidably situated within the sleeve and adapted to be moved between the retaining rings. As shown in FIG. 1, a lower end of the inboard edge of each leg is beveled to conform to the conical end of the punch.

As such, the legs may be biased inwardly via the stopper until a pointed bottom of the legs are capable of residing on a designated circle formed on a recipient surface. Once the legs are rested on the recipient surface, a hammer or the like may be used to strike a top end of the punch thereby forming a hole at a center of the designated circle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hole puncher comprising, in combination:

a central sleeve having a rigid cylindrical configuration with an open top end, an open bottom end and a periphery formed therebetween, an outer surface of an upper extent of the periphery having a plurality of threaded grooves formed therein and three spaced posts coupled thereto just below the threaded grooves and extending radially therefrom, each post having an outboard end with a horizontally oriented aperture and a vertically oriented slot;

three legs each constructed from an elongated planar plate having an elongated lower extent with an arcuate inboard edge and an arcuate outboard edge and an angled short upper extent forming an obtuse angle with the lower extent, each leg pivotally coupled at a point just below an intersection of the upper and lower extent within the slot of a corresponding one of the posts of the sleeve;

a leg adjustment assembly including a stopper having a cylindrical upper extent and a lower extent with an inverted frustoconical configuration, the stopper having a threaded bore formed therein for screwably coupling with the grooves of the sleeve for biasing the lower extent of each leg inwardly, the leg adjustment assembly further including an elastic band situated about the legs at the intersections thereof for urging the upper extents of the legs in constant abutment with the stopper; and a punch having a cylindrical configuration with a conical lower end with a retaining ring mounted thereabove and an upper end with another retaining ring mounted thereon, the punch being slidably situated within the sleeve and adapted to be moved between the retaining rings.

2. A hole puncher comprising:

a central sleeve having an open top end, an open bottom end and a periphery formed therebetween, an outer surface of an upper extent of the periphery having a plurality of grooves formed therein and three spaced posts coupled thereto just below the grooves and extending radially therefrom, each post having an outboard end with a horizontally oriented aperture and a vertically oriented slot;

at least three legs pivotally coupled to the central sleeve adapted to extend radially from the sleeve, each leg having an elongated lower extent with an inboard edge and an outboard edge and a short upper extent forming an obtuse angle with the lower extent, each leg pivotally coupled at a point just below an intersection of the upper and lower extent within the slot of a corresponding one of the posts of the sleeve;

a leg adjustment assembly including a stopper having an upper extent and a lower extent with an inverted frusto-conical configuration, the stopper having a threaded bore formed therein for coupling with the grooves of the sleeve for biasing the lower extent of each leg inwardly, the leg adjustment assembly further including an elastic band situated about the legs at the intersections thereof for urging the upper extents of the legs in constant abutment with the stopper; and a punch having a conical lower end with a retaining ring mounted thereabove and an upper end with another retaining ring mounted thereon, the punch being slidably situated within the sleeve and adapted to be moved between the retaining rings.

3. A hole puncher as set forth in claim 2 wherein lower ends of the legs are adapted to always remain a constant distance from the sleeve.

4. A hole puncher as set forth in claim 2 wherein a pair of retainers constrain movement of the punch within the sleeve.

5. A hole puncher as set forth in claim 2 wherein the legs each have a slanted inboard edge.

6. A hole puncher comprising:

a central sleeve having an outer surface with a plurality of grooves formed therein and three spaced posts coupled to the sleeve below the grooves and extending radially therefrom, each post having an outboard end with an aperture and a slot;

at least three legs pivotally coupled to the central sleeve adapted to extend radially from the sleeve, each leg having an elongated lower extent with an inboard edge and an outboard edge and a short upper extent, each leg pivotally coupled at a point just below an intersection of the upper and lower extent within the slot of a corresponding one of tile posts of the sleeve;

a leg adjustment assembly including a stopper having an upper extent and a lower extent with an inverted frusto-conical configuration, the stopper having a threaded bore formed therein for coupling with the grooves of the sleeve for biasing the lower extent of each leg inwardly, the leg adjustment assembly further including an elastic band situated about the legs at the intersections thereof for urging the upper extents of the legs in constant abutment with the stopper; and a punch having a conical lower end with a retaining ring mounted thereabove and an upper end with another retaining ring mounted thereon, the punch being slidably situated within the sleeve and adapted to be moved between the retaining rings.

7. A hole puncher as set forth in claim 6 wherein lower ends of the legs are adapted to always remain a constant distance from the sleeve.

8. A hole puncher as set forth in claim 6 wherein at least one retainer constrains movement of the punch within the sleeve.

9. A hole puncher as set forth in claim 6 wherein the legs each have a slanted inboard edge.

10. A hole puncher as set forth in claim 6 wherein the legs each have an arcuate outboard edge.

* * * * *